US008119063B2

(12) United States Patent
Loucif et al.

(10) Patent No.: US 8,119,063 B2
(45) Date of Patent: Feb. 21, 2012

(54) AUSTENITIC IRON AND AN IRON PRODUCT

(75) Inventors: Hachemi Loucif, Karlskoga (SE); Mats Liljas, Avesta (SE)

(73) Assignee: Outokumpu Oyj, Espoo (FI)

( * ) Notice: Subject to any disclaimer, the term of this patent is extended or adjusted under 35 U.S.C. 154(b) by 123 days.

(21) Appl. No.: 11/722,870

(22) PCT Filed: Dec. 28, 2005

(86) PCT No.: PCT/SE2005/002057

§ 371 (c)(1),
(2), (4) Date: Jun. 26, 2007

(87) PCT Pub. No.: WO2006/071192

PCT Pub. Date: Jul. 6, 2006

(65) Prior Publication Data

US 2008/0095656 A1 Apr. 24, 2008

(30) Foreign Application Priority Data

Dec. 28, 2004 (SE) ..... 0403197

(51) Int. Cl.
*C22C 38/38* (2006.01)
*C22C 38/22* (2006.01)
*C22C 30/00* (2006.01)

(52) U.S. Cl. ..... 420/46; 420/59; 420/586.1; 420/582; 148/327; 148/442; 148/541; 148/542; 148/538; 148/707

(58) Field of Classification Search ..... 420/46, 420/59, 582, 586.1; 148/327, 442, 541, 542, 148/538, 707
See application file for complete search history.

(56) References Cited

U.S. PATENT DOCUMENTS

| | | | | |
|---|---|---|---|---|
| 2,696,433 | A * | 12/1954 | Tanczyn | 420/34 |
| 5,480,609 | A * | 1/1996 | Dupoiron et al. | 420/45 |
| 5,494,636 | A * | 2/1996 | Dupoiron et al. | 420/586.1 |
| 5,841,046 | A * | 11/1998 | Rhodes et al. | 75/246 |
| 2003/0143105 | A1 | 7/2003 | Bahar et al. | |

FOREIGN PATENT DOCUMENTS

| | | | |
|---|---|---|---|
| DE | 3729577 | | 9/1988 |
| EP | 0342574 | | 11/1989 |
| EP | 0438992 | | 7/1991 |
| EP | 0507229 | | 10/1992 |
| JP | 55-21547 | * | 2/1980 |
| JP | 6145913 | | 5/1994 |
| JP | 10-60610 | * | 3/1998 |

OTHER PUBLICATIONS

Human English translation of Japanese patent 355021547 to Chiba et al, Feb. 15, 1980.*

Machine-English translation of Japanese patent 06-145913, Azuma Shigeki et al., May 27, 1994.*

* cited by examiner

*Primary Examiner* — Deborah Yee

(74) *Attorney, Agent, or Firm* — Chernoff, Vilhauer, McClung & Stenzel

(57) ABSTRACT

High-alloy austenitic stainless steels that are extra resistant to pitting and crevice corrosion in aggressive, chloride-containing solutions have a tendency for macro-segregation of Mo, at solidification of the melt. This problem is solved by a super austenite stainless steel having the following composition, in % by weight: max 0.03 C, max 0.5 Si, max 6 Mn, 28-30 Cr, 21-24 Ni, 4-6% (Mo+W/2), the content of W being max 0.7, 0.5-1.1 N, max 1.0 Cu, balance iron and impurities at normal contents originating from the production of the steel.

16 Claims, 3 Drawing Sheets

V276H (654SMO) 100x

V277H (B66) 200x

V275H (28Cr) 100x

V278H (28Cr) 100x

V279H (28Cr) 100x

AUSTENITIC IRON AND AN IRON PRODUCT

TECHNICAL FIELD

The present invention relates to an austenitic iron alloy with good strength, good impact strength, good weldability and good corrosion resistance, in particular a good resistance against pitting and crevice corrosion. The invention also relates to a product manufactured from the austenitic iron alloy.

PRIOR ART

When the stainless, austenitic steel Avesta 254 SMO®, containing a little more than 6% molybdenum, (Mo), (U.S. Pat. No. 4,078,920) was introduced on the market, more than twenty years ago, a significant technical progress was achieved, since corrosion and strength properties were considerably much better than for high-alloy steels existing then.

In the present text, the terms "content" and "percentage" always refer to the content in "% by weight", and in case only a numerical value is given, it refers to content in % by weight.

The sensitivity to pitting is an Achilles' heel to stainless steels. It is well known that the elements chromium (Cr), Mo and nitrogen (N) prevent pitting, and a great number of steels exist that are well protected against this type of corrosion. Such steels are also improved in terms of crevice corrosion resistance, which is similarly affected by the same elements. The superaustenitic steels are in a class of their own. The superaustenitic steels are usually defined as steels having a pitting resistance equivalent PRE>40. PRE is often defined as % Cr+3.3% Mo+30% N. A great number of super austenite steels have been described during the past thirty years, but only a limited number are of commercial significance. Of those steels can be mentioned the above mentioned 254 SMO (EN 1.4547, UNS S31254), 19-25 hMo (EN 1.4529, UNS N08926) and AL-6XN (UNS N08367) (U.S. Pat. No. 4,545,826, McCunn et al.). These superaustenitic steels are of 6Mo-steel type, having about 20% Cr, 6% Mo and 0.20% N, which gives a PRE>46, and they have been used with great success since the 1980's.

The large effect by N on pitting makes it interesting to add higher contents than about 0.2%. Traditionally, high contents of manganese have been used in order to dissolve high contents of N in the steel. One example of such a steel is 4565 (EN 1.4565, UNS S34565), having 24% Cr, 6% Mn, 4.5% Mo and 0.4% N and a PRE-level similar to that of the 6Mo-steels according to the above (DE-C1-37 29 577, Thyssen Edelstahlwerke).

An increased content of Mo is of course valuable in order to further increase pitting resistance. This has been done in the steel Avesta 654 SMO®, (EN UNS S 32654) having 24% Cr, 3.5% Mn, 7.3% Mo, 0.5% N (U.S. Pat. No. 5,141,705). This steel has a PRE-level as high as >60, and in many respects it is equally corrosion resistant as the best nickel alloys. By the high Cr and Mo contents, as much as 0.5% N could be dissolved at a fairly moderate Mn content. The high N content gives the steel a good strength combined with a good ductility. A quite similar variant of 654 SMO, in which a certain part of the Mo is exchanged for W, is the steel B66 (EN 1.4659, UNS S 31266) (U.S. Pat. No. 5,494,636, Dupoiron et al.).

One problem of fully austenitic steels with high contents of Mo is the severe segregation tendency of Mo. This results in segregated areas in ingots or continuous casts, still largely remaining in the final products and giving rise to precipitations of intermetallic phases, such as a sigma phase. This phenomenon is particularly prominent in the most highly alloyed steels, and various procedures exist in order to counteract or reduce the effects thereof in latter stages.

In continuous casting of steels with a tendency for segregations, there is a risk of macro-segregations leading to various problems in the final product. Macro-segregations form by alloying elements being distributed between the solid phase and residual melt, during the casting, such that differences in composition arise between different areas of the solidified blank, depending on cooling, flows and manner of solidification. So called A- and V-segregations are classical for ingots, as well as centre segregations in continuous casting. It is well established that Mo is an element having a particularly high tendency for segregation, and hence, steels of the highest Mo contents often exhibit severe macro-segregations. Such macro-segregations are difficult to eliminate in subsequent production steps, and most often result in precipitation of intermetallic phases. Such phases can cause laminations in rolling, and also impair product properties such as corrosion resistance and toughness. Hence, superaustenitic steels with a very high content of Mo often get centre segregations in continuously cast blanks, which severely limit the possibility to produce homogeneous sheets of optimum properties. The problems are particularly pronounced in sheets with greater thicknesses and sheets with a thickness greater than 15 mm is hardly produced without deterioration of the properties. Hence, a need exists for a high-alloy austenitic stainless steel that is not prone to macro-segregations and which can be used in the manufacturing of products of greater thickness.

BRIEF ACCOUNT OF THE INVENTION

The object of the present invention is accordingly to achieve a new austenitic stainless steel that is highly alloyed, especially in terms of Cr, Mo and N. The so called superaustenitic steel is characterised by very good corrosion resistance and strength. The steel is adapted, in various processed forms, such as sheets, bars and pipes, for use in aggressive environments in chemical industry, power plants and various seawater applications.

The invention aims especially at achieving a material that advantageously can be used within the following fields of application:

- within off-shore industry (seawater, acidic oil and gas)
- for heat exchangers and condensers (seawater)
- for desalination plants (saltwater)
- for equipment for flue gas cleaning (chloride acids)
- for equipment for flue gas condensing (strong acids)
- in sulphuric and phosphoric acid works (strong acids)
- for pipes and equipment for generation of oil and gas (acidic oil and gas)
- for equipment and pipes in cellulose bleaching plants and in chlorate works (chloride, oxidizing acids and solutions, respectively)
- for tankers and tank lorries (all types of chemicals)

This object is achieved by an austenitic stainless steel having the following composition, in % by weight:

max 0.03 C
max 0.5 Si
max 6 Mn
28-30 Cr
21-24 Ni
4-6% (Mo+W/2), the content of W being max 0.7
0.5-1.1 N
max 1.0 Cu
balance iron and impurities at normal contents originating from the production of the steel.

It has been shown that by limiting the content of Mo, and alloying-in more CR, a superaustenitic steel is achieved having a very good pitting resistance and markedly lower tendency for structural segregations.

Besides the mentioned alloying elements, the steel may also contain small contents of other elements, provided that these will not negatively affect the desired properties of the steel, which properties are mentioned above. The steel may e.g. contain boron at a content of up to 0.005% B, with the purpose of achieving an additional increase of the steel's ductility in hot working. In case the steel contains cerium, the steel normally also contains other rare earth metals, since such elements, including cerium, are normally added in the form of a mish-metal at a content of up to 0.1%. Calcium and magnesium can furthermore also be added to the steel at contents of up to 0.01%, and aluminium can be added to the steel at contents of up to 0.05%, of the respective elements, for different purposes.

Considering the various alloying materials, the following furthermore applies:

In this steel, carbon is to be seen mainly as a non-desired element, since carbon will severely lower the solubility of N in the melt. Carbon also increases the tendency for precipitation of harmful Cr carbides, and for these reasons it should not be present at contents above 0.03%, and preferably it should be 0.015-0.025%, suitably 0.020%.

Silicon increases the tendency for precipitation of intermetallic phases, and severely lowers the solubility of N in the steel melt. Therefore, silicon should exist at a content of max 0.5%, preferably max 0.3%, suitably max 0.25%.

Manganese is added to the steel in order to affect the solubility of N in the steel, as is known per se. Therefore, manganese is added to the steel at a content of up to 6%, preferably at least 4.0% and suitably 4.5-5.5%, most preferred about 5.0%, in order to increase the solubility of N in the molten phase. High contents of manganese will however lead to problems in decarburization, since the element, just as Cr, will lower the activity of carbon, whereby decarburization becomes slower. Manganese has moreover a high steam-pressure and a high affinity for oxygen, which means that if the content of manganese is high, a considerable amount of manganese will be lost in decarburization. It is also known that manganese can form sulphides that will lower the resistance against pitting and crevice corrosion. Research in connection with the development of the inventive steel has also shown that manganese dissolved in the austenitic will impair corrosion resistance also when manganese sulphides are non-present. For these reasons, the content of manganese is limited to max 6%, preferably max 5.5%, suitably about 5.0%.

Cr is a particularly important element in this, as in all, stainless steels. Cr will generally increase corrosion resistance. It also increases the solubility of N in molten phase more strongly than other elements of the steel. Therefore, Cr should exist in the steel at a content of at least 28.0%.

However, Cr, especially in combination with Mo and silicon, will increase the tendency of precipitation of intermetallic phases, and in combination with N, it also increases the tendency for precipitation of nitrides. This will influence for example welding and heat treatment. For this reason, the content of Cr is limited to 30%, preferably max 29.0%, suitably to 28.5%.

Nickel is an austenitic former, and is added in order to, in combination with other austenitic formers, give the steel its austenitic micro-structure. An increased content of nickel will also counteract precipitation of intermetallic phases. For these reasons, nickel should exist in the steel at a content of at least 21%, preferably at least 22.0%.

Nickel will however lower the solubility of N in the steel, in the molten phase, and will also increase the tendency for precipitation of carbides in the solid phase. Moreover, nickel is an expensive alloying element. Hence, the content of nickel is limited to max 24%, preferably max 23%, suitably max 22.6% Ni.

Mo is one of the most important elements in this steel, by strongly increasing corrosion resistance, especially against pitting and crevice corrosion, at the same time as the element increases the solubility of N in the molten phase. The tendency for nitride precipitation also decreases at an increasing content of Mo. Therefore, the steel should contain more than 4% Mo, preferably at least 5% Mo. It is however well established that Mo is an element of particularly large tendency for segregation. The segregations are difficult to eliminate in subsequent production steps. Moreover, Mo will increase the tendency for precipitation of intermetallic phases, e.g. in welding and heat treatment. For these reasons, the content of Mo must not exceed 6%, and preferably it is about 5.5%.

If tungsten is included in the stainless steel, it will interact with Mo, such that the above given contents of Mo will be total contents of Mo+W/2, i.e. the actual contents of Mo will have to be lowered. The maximum content of tungsten is 0.7% W, preferably max 0.5%, suitably max 0.3%, and even more preferred max 0.1% W.

Also N is an important alloying element of the present steel. N will increase resistance against pitting and crevice corrosion very strongly, and will radically increase strength, at the same time as a good impact strength and workability is maintained. N is at the same time a cheap alloying element, since it can be alloyed into the steel via a mixture of air and N gas, in the decarburization in a converter.

N is also a strongly austenitic stabilising alloying element, which also gives several advantages. Some alloying elements will segregate strongly in connection with welding. This is particularly true for Mo, that exists at high contents in the steel according to the invention. In the interdendritic areas, the contents of Mo will most often be so high that the risk of precipitation of intermetallic phases becomes high. During the research for the steel according to the invention, it has surprisingly been shown that austenitic stability is so good that the interdendritic areas, despite the high contents of Mo, will retain their austenitic microstructure. The good austenite stability is an advantage e.g. in connection with welding without additives, since it results in the weld deposit having extremely low contents of secondary phases, and thus a higher ductility and corrosion resistance.

The most common intermetallic phases in this type of steel are Laves' phase, sigma phase, and chi phase. All these phases have very low or none N solubility. For this reason, the N can delay precipitation of Laves' phase, sigma phase and chi phase. A higher content of N will accordingly increase stability against precipitation of intermetallic phases. For these reasons, N should exist in the steel at a content of at least 0.5%, preferably at least 0.6% N.

Too high contents of N will however increase the tendency for precipitation of nitrides. High contents of N will also impair hot workability. Therefore, the N content of the steel should not exceed 1.1%, preferably max 0.9%, and even more preferred max 0.8% N. A preferred amount of N lay in the interval of 0.6-0.8% N.

It is known that in certain austenitic stainless steels, copper can improve corrosion resistance against certain acids, while resistance against pitting and crevice corrosion can be impaired at too high contents of copper. Therefore, copper can exist at significant contents in the steel of up to 1.0%. Extensive research has shown that there is an optimum content range for copper, concerning corrosion properties in various media. For this reason, copper should be added at a content of at least 0.5%, but suitably within the range of 0.7-0.8% Cu.

Cerium may optionally be added to the steel, e.g. in the form of a mish metal, in order to improve hot workability for the steel, as is known per se. In case a mish metal is added, the steel will besides cerium also contain other rare earth metals, such as Al, Ca and Mg. In the steel, cerium will form cerium oxy sulphides that do not impair corrosion resistance as much as other sulphides do, such as manganese sulphide. For these reasons, cerium and lanthanum may be included in the steel at significant contents of up to max 0.1%.

Preferably, the alloying elements of the stainless steel are balanced against each other such that the steel contains Cr, Mo and N at such an amount that a PRE-value of at least 60 is achieved, where PRE=Cr+3.3Mo+1.65W+30N. Suitably, the PRE-value is at least 64, most preferred at least 66.

In a particularly preferred embodiment, the austenitic stainless steel has a composition containing, in % by weight:
max 0.02 C
0.3 Si
5.0 Mn
28.3 Cr
22.3 Ni
5.5 Mo
0.75 Cu
0.65 N
balance iron and impurities at normal contents originating from the production of the steel, and after heat treatment at a temperature of 1150-1220° C., the steel has a homogeneous microstructure mainly consisting of austenite and being essentially free from harmful amounts of secondary phases.

Austenitic stainless steels having a composition according to the above are very well suited to be continuously cast to form flat or long products. Without any remelting process, they can be hot rolled to a final dimension of up to 50 mm at a reduction rate of at least 1:3 with a low level of segregation. After heat treatment at a temperature of 1150-1220° C. they have a micro-structure mainly formed by austenite and essentially free from harmful amounts of secondary phases. Of course, the steel is also suited for other methods of manufacturing, such as ingot casting and powder metallurgical handling.

BRIEF DESCRIPTION OF THE ENCLOSED DRAWINGS

UNDERTAKEN EXPERIMENTS

Figure 1:
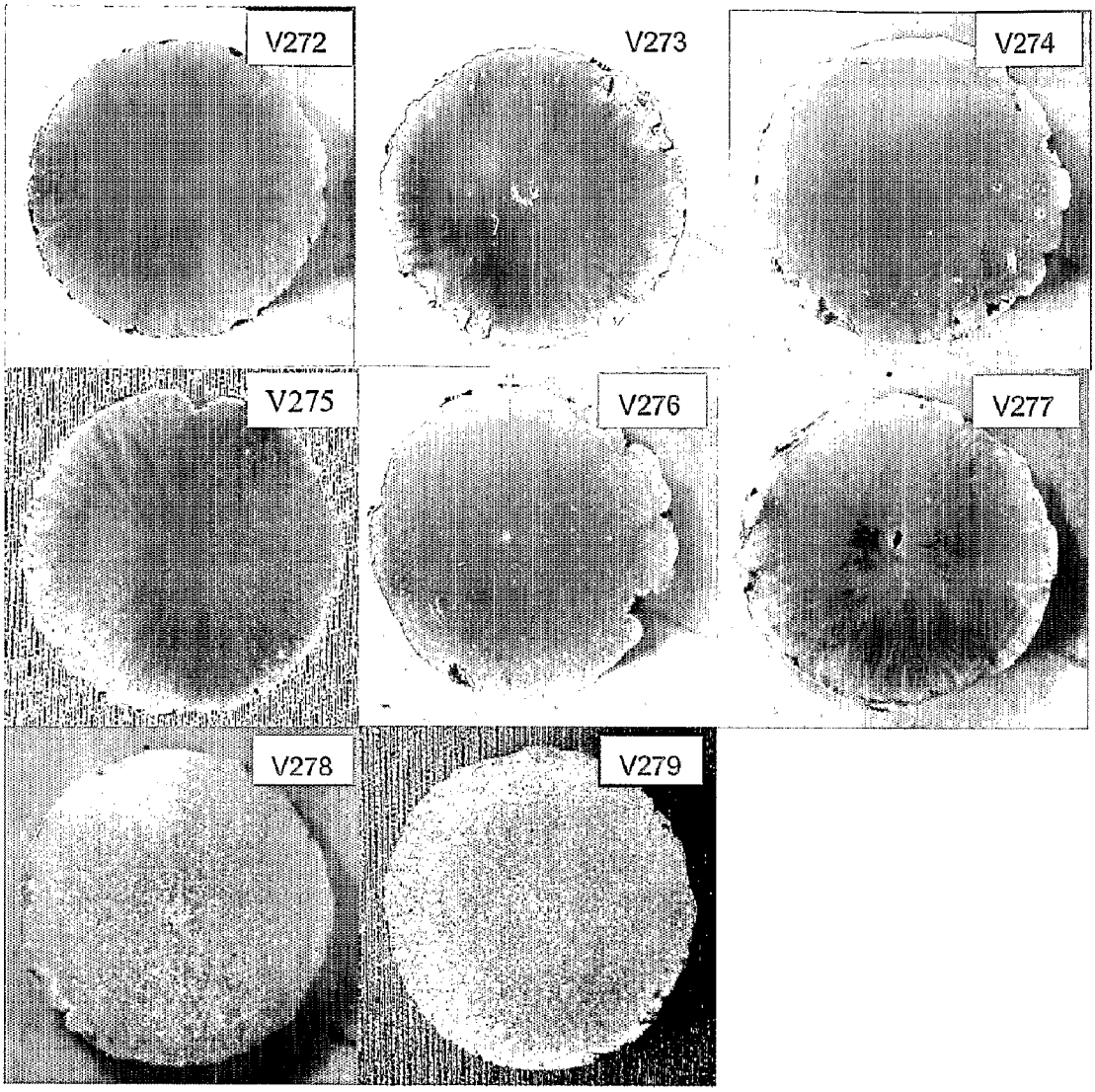
FIG. 1 shows macro-photographs of various ingots, in cross-section.

Laboratory ingots of 2.2 kg respectively were produced of high Cr alloys as well as commercial steels 654 SMO® and B66. A high frequency induction furnace with N or argon as protective gas was used for melting. Detailed melting data is summarized in Table 1. In the experiments, charges V274, V275, V278 and V279 are denoted 28Cr, and they are of compositions that in the main correspond to steels according to the present patent application. The dimensions of the laboratory ingots were a length of about 190 mm and a middle diameter of 40 mm. Samples were taken both in cross-section, for metallographic analysis, and longitudinally for pitting studies.

TABLE 1

| Alloys | Charge No. | Liquidus temperature (° C.)* | Tapping temperature (° C.) | Superheat temperature ΔT(° C.) | Protective gas | Macro-crevices/ pores |
|---|---|---|---|---|---|---|
| 654 SMO | V272 | 1320 | 1668 | 348 | 400 torr $N_2$ | No |
| B66 | V273 | 1332 | 1553 | 221 | 400 torr $N_2$ | Yes |
| 28Cr | V274 | 1297 | 1420 | 123 | 200 torr Ar | Yes |
| 28Cr | V275 | 1297 | 1445 | 148 | 200 torr Ar | No |
| 654 SMO | V276 | 1320 | 1418 | 98 | 200 torr Ar | Yes |
| B66 | V277 | 1331 | 1486 | 155 | 200-760 torr Ar | No |
| 28Cr | V278 | 1297 | 1385 | 88 | 200-760 torr $N_2$ | No |
| 28Cr | V279 | 1297 | 1387 | 90 | 200-760 torr $N_2$ | No |

Metallographic Analysis

The samples, from cast as well as annealed ingots, were face-ground, polished and etched. Björk's solution (5 g $FeCl_3.6H_2O$+5 g $CuCl_2$+100 ml HCl+150 ml $H_2O$+25 ml $C_2H_5OH$) was used for macro-structural etching, and modified V2A (100 ml $H_2O$+100 ml HCl+5 ml $HNO_3$+6 g $FeCl_3.6H_2O$) was used for micro-structural etching.

The chemical compositions of all tested charges are given in Table 2, in which all numerical data in bold font deviate from the standard specification for the commercial steels. All analysed samples were taken from the bottom parts of the ingots. For charges V278 and V279, both the top part and the bottom part were analysed, showing a homogeneous chemical composition of the ingots. Alloy 28Cr has a high solubility of N, 0.72% by weight of N being achieved in the steel. It seems possible to increase N content even further. The reason for this is believed to be that the increase of Cr and manganese contents has a truly positive effect on the solubility of N.

TABLE 2

Chemical compositions of various ingots (% by weight) Bold font numerical data is outside standard specification ASTM A240

| Alloy | Charge No. | C | Si | Mn | P | S | Cr | Ni | Mo | Ti | Nb | Cu |
|---|---|---|---|---|---|---|---|---|---|---|---|---|
| 654 SMO | Original sheet | 0.014 | 0.24 | 3.37 | 0.020 | 0.000 | 24.25 | 21.84 | 7.27 | — | 0.00 | 0.49 |
| 654 SMO | V272 | 0.012 | 0.46 | 3.19 | 0.021 | 0.002 | 24.57 | 22.11 | 7.29 | <0.001 | 0.010 | 0.52 |
| 654 SMO | V276 | 0.013 | 0.25 | 3.51 | 0.015 | 0.002 | 24.80 | 22.40 | 7.27 | <0.001 | 0.006 | 0.48 |
| B66 | Original sheet | 0.016 | 0.19 | 3.14 | 0.022 | 0.002 | 23.38 | 21.64 | 5.33 | 0.002 | 0.003 | 1.42 |
| B66 | V273 | 0.014 | **1.30** | **1.09** | 0.018 | 0.001 | 22.91 | 22.08 | 5.65 | <0.001 | 0.003 | 1.49 |
| B66 | V277 | 0.017 | 0.20 | 3.36 | 0.021 | 0.004 | 24.01 | 22.28 | 5.74 | <0.001 | 0.003 | 1.42 |
| 28Cr | V274 | 0.020 | 0.23 | 4.99 | 0.012 | 0.004 | 28.48 | 22.41 | 5.59 | <0.001 | 0.005 | 0.72 |
| 28Cr | V275 | 0.019 | 0.26 | 5.24 | 0.013 | 0.002 | 27.98 | 22.11 | 5.56 | <0.001 | 0.005 | 0.72 |
| 28Cr (top) | V278 | 0.017 | 0.27 | 5.32 | 0.015 | 0.002 | 28.42 | 22.15 | 5.56 | <0.001 | 0.006 | 0.79 |
| 28Cr (bottom) | V278 | 0.017 | 0.27 | 5.32 | 0.015 | 0.002 | 28.47 | 22.62 | 5.58 | <0.001 | 0.006 | 0.74 |
| 28Cr (top) | V279 | 0.019 | 0.27 | 5.36 | 0.014 | 0.003 | 28.47 | 22.16 | 5.60 | 0.0000 | 0.005 | 0.71 |
| 28Cr (bottom) | V279 | 0.023 | 0.27 | 5.33 | 0.014 | 0.002 | 28.39 | 22.60 | 5.58 | <0.001 | 0.005 | 0.72 |

| | Charge No. | Co | N | Sn | As | W | V | Al | B | O | PRE* |
|---|---|---|---|---|---|---|---|---|---|---|---|
| 654 SMO | Original sheet | — | 0.520 | — | — | — | — | — | — | — | 63.8 |
| 654 SMO | V272 | 0.079 | **0.303** | 0.05 | 0.007 | 0.020 | 0.067 | <0.001 | 0.0003 | — | 57.8 |
| 654 SMO | V276 | 0.074 | **0.37** | 0.004 | 0.007 | 0.020 | 0.051 | <0.001 | 0.0002 | 0.0101 | 59.9 |
| B66 | Original sheet | 0.069 | 0.449 | 0.001 | 0.006 | 1.76 | 0.048 | 0.013 | 0.0008 | — | 57.3 |
| B66 | V273 | 0.065 | 0.453 | 0.001 | 0.005 | 1.87 | 0.041 | 0.002 | 0.0002 | — | 58.2 |
| B66 | V277 | 0.074 | 0.373 | 0.001 | 0.008 | 1.73 | 0.043 | <0.001 | 0.0008 | 0.018 | 57.0 |
| 28Cr | V274 | 0.075 | 0.483 | 0.004 | 0.004 | 0.020 | 0.056 | <0.001 | 0.0002 | — | 61.5 |
| 28Cr | V275 | 0.081 | 0.53 | 0.002 | 0.005 | 0.020 | 0.056 | <0.001 | 0.0002 | 0.0213 | 62.3 |
| 28Cr (top) | V278 | 0.088 | 0.72 | 0.005 | 0.008 | 0.070 | 0.064 | <0.001 | 0.0002 | 0.0101 | 68.5 |
| 28Cr (bottom) | V278 | 0.088 | 0.72 | 0.006 | 0.006 | 0.070 | 0.064 | <0.001 | 0.0002 | 0.0101 | 68.6 |
| 28Cr (top) | V279 | 0.090 | 0.71 | 0.005 | 0.007 | 0.020 | 0.063 | <0.001 | 0.0002 | 0.0159 | 68.3 |
| 28Cr (bottom) | V279 | 0.087 | 0.67 | 0.006 | 0.008 | 0.020 | 0.063 | <0.001 | 0.0002 | 0.0135 | 66.9 |

*PRE = Cr + 3,3Mo + 1.65W + 30N

Macro-photographs of analysed ingots are shown in cross-section in FIG. 1, in which the volume proportion of equiaxed zone was measured, giving the results shown in Table 3. A equiaxed zone is fully developed in charges V274, V276, V278 and V279, while the other charges have a very low proportion of equiaxed zone, primarily caused by differences in tapping temperatures. In general, an increased casting temperature will result in an increased columnar crystal zone. Ingots of 28Cr (V278 and V279) have successfully been produced with a weakly segregated middle line, and really few pores (observed on the longitudinal sections of the ingots). Table 3 also gives the amount of measured intermetallic phase, which according to analysis by SEM-EDS (Table 4) is sigma phase (C-phase). Vicker hardness is also included in Table 3. Hardness measurements were made on metallographic samples, using a load of 1 kg. Mean values were obtained from the five measurements in the intermediate area between the middle and the surface. The hardness is proportional to the N content in the steel.

TABLE 3

| Alloy | Charge No. | Proportion of uniform axis zone (% by volume) | Nitrogen content (% by weight) | Amount of σ-phase (% by volume) | Hardness (HV) |
|---|---|---|---|---|---|
| 654 SMO | V272 | 0 | 0.30 | 7.9 | 225 |
| 654 SMO | V276 | 100 | 0.37 | 5.3 | 222 |
| B66 | V273 | 15 | 0.45 | 1.4 | 236 |
| B66 | V277 | 4 | 0.37 | 0.5 | 209 |
| 28Cr | V274 | 100 | 0.48 | 2.1 | 230 |
| 28Cr | V275 | 16 | 0.53 | 0.9 | 229 |
| 28Cr | V278 | 100 | 0.72 | <0.1 | 265 |
| 28Cr | V279 | 100 | 0.69 | <0.1 | 262 |

TABLE 4

σ-phase composition in all ingots (% by weight), achieved from analysis by EDS/SEM

| Alloy | Charge No. | Si | Cr | Mn | Fe | Ni | Mo | Cu | W |
|---|---|---|---|---|---|---|---|---|---|
| 654 SMO | V272 | 0.9 | 30.9 | 3.0 | 33.8 | 13.1 | 18.4 | — | — |
| 654 SMO | V276 | 0.6 | 30.7 | 3.2 | 32.9 | 13.8 | 18.7 | — | — |
| B66 | V273 | 0.34 | 25.2 | 1.0 | 25.1 | 15.1 | 24.0 | — | 6.3 |
| B66 | V277 | 0.35 | 28.0 | 3.3 | 30.1 | 14.5 | 19.1 | — | 4.8 |
| 28Cr | V274 | 0.6 | 33.4 | 5.2 | 30.4 | 15.5 | 14.9 | — | — |
| 28Cr | V275 | 0.8 | 33.0 | 5.9 | 27.2 | 15.7 | 17.4 | — | — |
| 28Cr | V278 | 0.9 | 34.4 | 5.2 | 27.6 | 14.2 | 17.7 | — | — |
| 28Cr | V279 | 0.7 | 34.6 | 5.5 | 28.0 | 14.8 | 16.1 | 0.4 | — |

Figure 2:
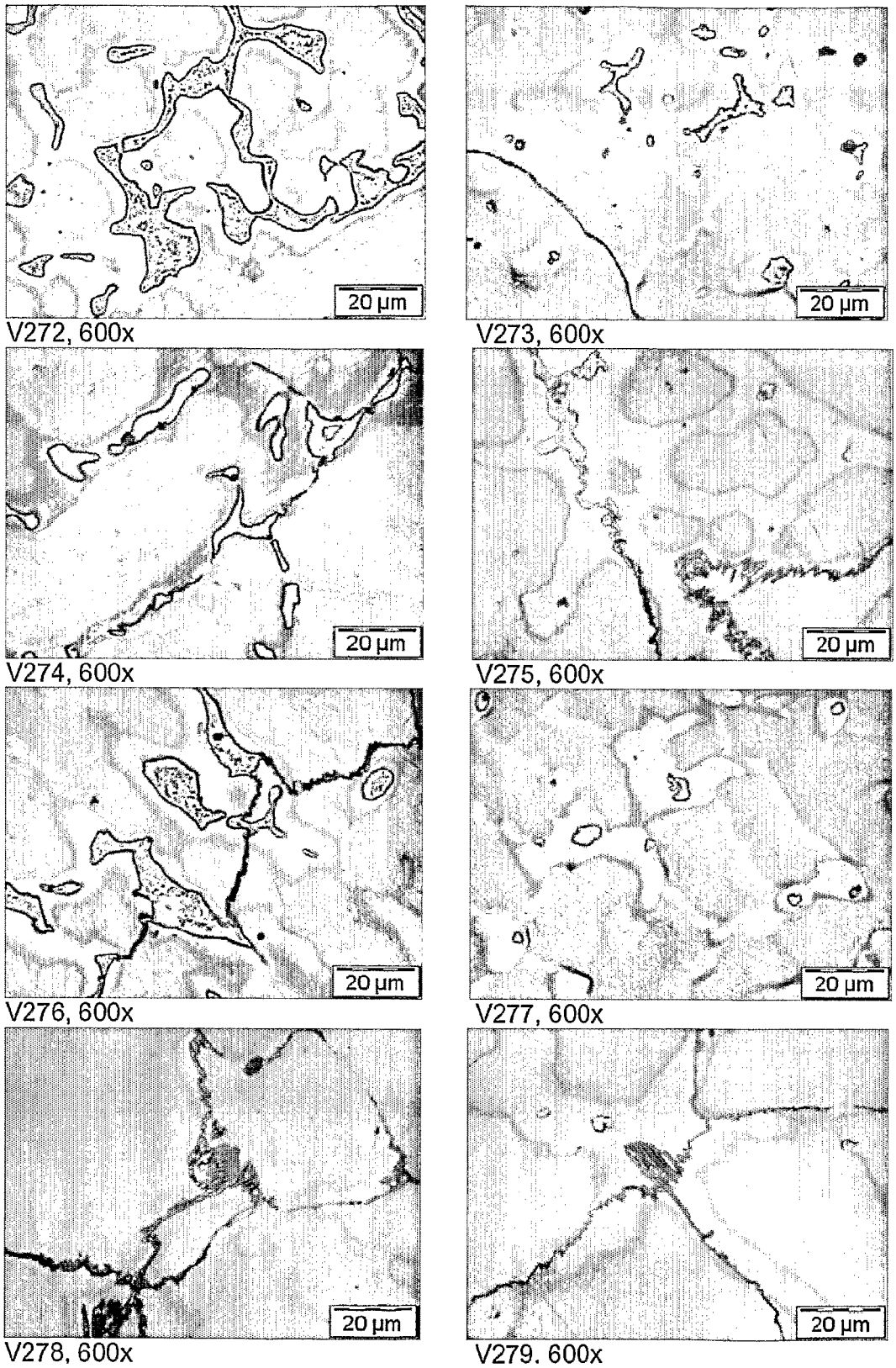
FIG. 2 shows micro-photographs of various cast alloys.

Casting structures are shown in FIG. 2. The amount of σ-phase in each produced ingot was measured from the surface to the middle of a cross-section according to cross index measurement (control instructions KF-10.3850/KFS 315, Avesta method) (see Table 3). Charges V272 and V276 (654 SMO) were high in σ-content, due to the all too low N content. For alloy 28Cr, the σ-phase content has been considerably decreased, thanks to the high N content of the steel. However, when N content is above 0.53% by weight, a needle-shaped precipitation has formed at the grain boundaries. The precipitations are so thin that it has not been possible to determine their compositions. It is supposed that they are constituted by $Cr_2N$-nitrides. In Acta Polytechnica Scandinavia, Me No. 128, Espoo 1988, J. Tervo reported that $Cr_2N$-nitrides will be precipitated in 654 SMO, when N content is above 0.55% by weight, and the nitrides are primarily formed at grain boundaries of similar appearance.

Figure 3:
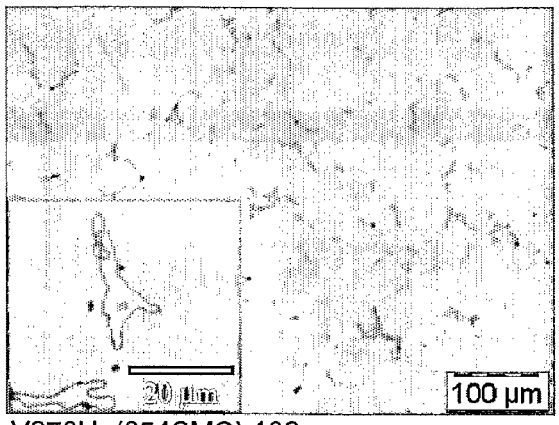
FIG. 3 shows micro-photographs of some representative cast alloys after full annealing at 1180° C. for 30 min, and quenching in water.
Figure 3:
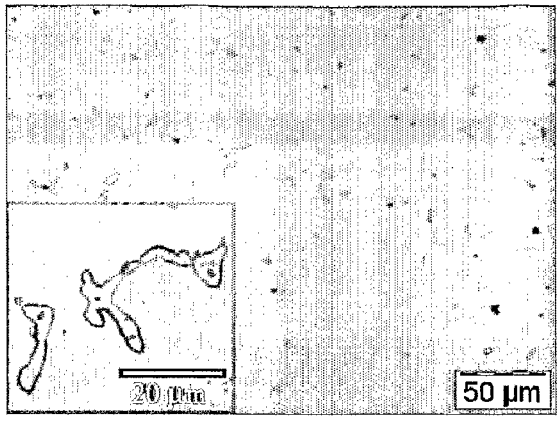
Figure 3:
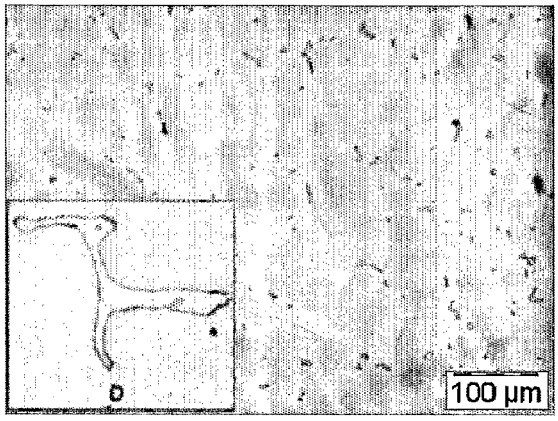
Figure 3:
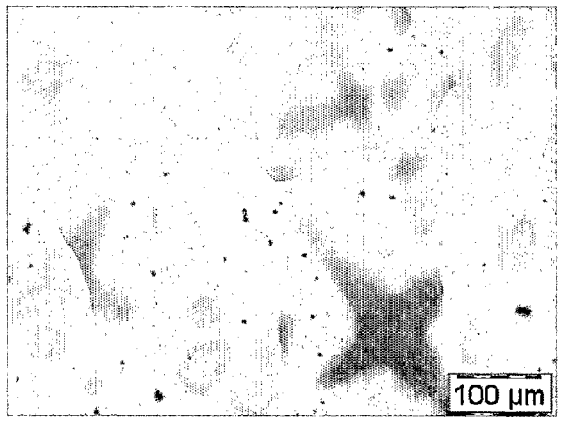
Figure 3:
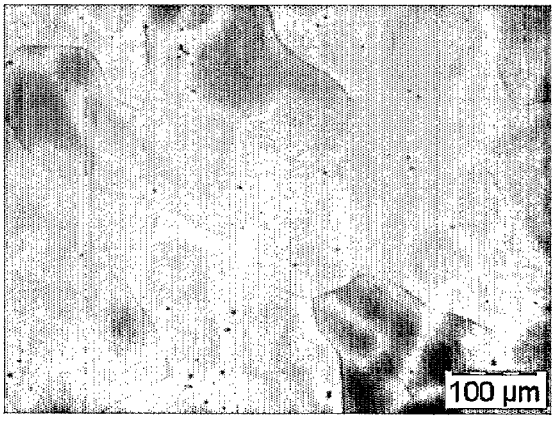

FIG. 3 shows the micro-structure achieved in annealing, for some representative alloys. In the structures of charges V272-V277, σ-phase is maintained. Due to the segregation effect, the annealing temperature used (1180° C.) may still be too low to remove the intermetallic phases. A micro-structure essentially void of intermetallic phases, for example σ-phase, should not have a value of more than 0.6 in cross index measurement according to the measuring method above. In the experiments with 28Cr, the needle-shaped phase however disappeared after solution annealing. A fully austenitic structure was obtained for the high N charges (V278 and V279).

Remelting by Spot Welding with TIG

As the tapping temperatures varied for the various ingots, it was hard to directly compare the segregation levels of alloys 28Cr (according to the present invention), and 654 SMO and B66, respectively. Accordingly, remelting was made by using spot welding with TIG on each sample of 28Cr, as well as on original sheets of 654 SMO and B66, respectively. Identical welding parameters were used (I=100 A, V=11 V, t=5 s, protective gas Ar at a flow of 10 l/min, and the same arc length.)

The segregation level of alloy 28Cr was compared to that of 654 SMO and B66, respectively. The distribution coefficient K was determined as is shown in Table 5. Si and Mo are the alloying elements of highest coefficient, i.e. they are the most segregating ones. The quotient is markedly lower for W, but it is still higher than the one for Cr. Accordingly, it is beneficial to have high contents of Cr, that exhibits the lowest tendency for segregation, and to keep the contents of Mo and silicon very low. Here, Tungsten takes up an intermediate level.

TABLE 5

EDS/WDS analyses for determination of the distribution coefficient K $K = C_{ID}/C_D$. $C_{ID}$ is the element content in the interdentritic centre; $C_D$ is the element content in the dendritic centre.

| | K | | | | | | | | |
|---|---|---|---|---|---|---|---|---|---|
| Alloy | Si | Cr | Mn | Fe | Ni | Cu | Mo | W | N |
| B66 | 4.06 | 1.06 | 1.26 | 0.88 | 0.98 | 1.25 | 1.70 | 1.14 | 1.18 |
| 654 SMO | 3.08 | 1.02 | 1.14 | 0.84 | 0.86 | 1.13 | 1.73 | — | 1.27 |
| 28CR-V274 | 1.96 | 1.02 | 1.27 | 0.87 | 0.99 | 1.35 | 1.68 | — | 1.07 |
| 28CR-V275 | 1.78 | 1.02 | 1.27 | 0.85 | 0.99 | 1.41 | 1.84 | — | 1.20 |
| 28CR-V278 | 1.96 | 1.02 | 1.24 | 0.87 | 1.00 | 1.14 | 1.58 | — | 1.24 |
| 28CR-V279 | 1.80 | 1.01 | 1.34 | 0.85 | 1.00 | 1.37 | 1.80 | — | 1.19 |

Corrosion Tests

Double samples were taken from the bottom part, close to the longitudinal section ingot surfaces, and were solution annealed at 1180° C. for 40 min, followed by quenching in water. The pitting temperature was thereafter measured on sample surfaces that had been ground by 320 grit grinding paper. The analysis was made in accordance with the standard ASTM G510 in 3M NaBr solution. The current density was potentiostatically monitored at +700 mV SCE, during a temperature scanning from 0° C. to 94° C. The critical pitting temperature (CPT) was defined as the temperature at which the current density exceeded 100 $\mu A/cm^2$, i.e. the point at which local pitting first took place. The results from the pitting test are shown in Table 6.

TABLE 6

Critical pitting temperature (CPT) for various alloys

| | | CPT (° C.) | | |
|---|---|---|---|---|
| Alloy | Charge no. | Test 1 | Test 2 | Mean value |
| 654 SMO | V276 | 79.1 | 81.8 | 80.5 |
| B66 | V277 | >87.0 | 85.4 | >86.2 |
| 28Cr | V274 | 67.5 | 61.4 | 64.5 |
| 28Cr | V275 | 68.0 | 59.6 | 63.9 |
| 28Cr | V278 | >93.0 | 70.5 | >81.8 |
| 28Cr | V279 | 79.1 | 89.2 | 84.2 |

The results show that pitting resistance is high for 28Cr (V278-9), and in some cases better than for the commercial steels.

CONCLUSIONS

Thanks to the high levels of Cr and manganese, a good solubility of N is achieved in alloy 28Cr. This good solubility of N, based on the higher Cr content, enables a lowering of the Mo content while all in all maintaining the PRE-value at the same level as for 654 SMO.

The increased N content lowers the amount of sigma phase markedly. In particular in the area of 0.67-0.72% by weight of N, the alloy 28Cr exhibits a fully austenite structure already in the casting stage, with very little needle-shaped nitrides formed at the grain boundaries, and being nearly free form sigma phase. After solution annealing at 1180° C. for 40 min, the nitrides could be completely removed.

The alloy 28Cr with the preferred N content has a good pitting resistance, similar to that of 654 SMO and B66.

The austenitic stainless steel according to the invention is accordingly very well adapted, in various processed forms, such as sheets, bars and pipes, for use in aggressive environments in chemical industry, energy plants and various seawater applications.

The invention claimed is:

1. An iron alloy product produced from an austenitic iron alloy having a composition of, in % by weight:

max 0.03 C
max 0.5 Si
4-6 Mn
28-29 Cr
22-23 Ni
4-6(Mo+W/2), the content of W being max 0.7
0.5-1.1 N
max 1.0 Cu
balance iron and impurities at normal contents originating from the production of the iron alloy,
and wherein the iron alloy has a low tendency to segregation and the production comprises casting of said iron alloy.

2. An iron alloy product according to claim 1, wherein the austenitic iron alloy contains 0.015-0.025 C.

3. An iron alloy product according to claim 2, wherein the austenitic iron alloy contains 0.020 C.

4. An iron alloy product according to claim 1, wherein the austenitic iron alloy contains max 0.3 Si.

5. An iron alloy product according to claim 1, wherein the austenitic iron alloy contains at least 4.5-5.5 Mn.

6. An iron alloy product according to claim 1, wherein the austenitic iron alloy contains max 0.5 W.

7. An iron alloy product according to claim 1, wherein the austenitic iron alloy contains 0.6 N.

8. An iron alloy product according to claim 7, wherein the austenitic iron alloy contains 0.6-0.8 N.

9. An iron alloy product according to claim 1, wherein the austenitic iron alloy contains 0.5 Cu.

10. An iron alloy product according to claim 1, wherein the austenitic iron alloy also contains one of:

max 0.005 B
max 0.1 Ce+La
max 0.05 Al
max 0.01 Ca
max 0.01 Mg.

11. An iron alloy product according to claim 1, wherein the austenitic iron alloy contains Cr, Mo and N at amounts such that a PRE-value of at least 60 can be obtained, where $$PRE=Cr+3.3Mo+1.65W+30N.$$

12. An iron alloy product according to claim 11, wherein the PRE-value is at least 64.

13. An iron alloy product according to claim 1, wherein the austenitic iron alloy contains:

max 0.3 Si
5-6 (Mo+W/2), and
0.6-0.9 N,
and after heat treatment at a temperature of 1150-1220° C., the iron alloy has a homogeneous microstructure mainly consisting of austenite and being essentially void of harmful amounts of secondary phases.

14. An iron alloy product produced from an austenitic iron alloy having a composition of, in % by weight:

max 0.03 C
max 0.5 Si
4-6 Mn
28-29 Cr
22-23 Ni
4-6(Mo+W/2), the content of W being max 0.7
0.5-1.1 N
max 1.0 Cu
balance iron and impurities at normal contents originating from the production of the iron alloy,
and wherein the alloy has a low tendency to segregation and the production comprises continuous casting of said iron alloy for forming flat or long products.

15. An iron alloy product according to claim 14, wherein the production comprises, without any remelting, hot rolling the continously cast product to a final dimension of max 50 mm at a reduction rate of at least 1:3, and wherein the hot rolled product has a micro-structure having a low level of segregation.

16. A method of manufacturing a iron alloy product, comprising:

providing an austenitic iron alloy having a low tendency to segregation and a composition of, in % by weight:
max 0.03 C
max 0.5 Si
4-6 Mn
28-29 Cr
22-23 Ni
4-6(Mo+W/2), the content of W being max 0.7
0.5-1.1 N
max 1.0 Cu
balance iron and impurities at normal contents originating from the production of the iron alloy, and
casting said iron alloy to form said product.

* * * * *

UNITED STATES PATENT AND TRADEMARK OFFICE

CERTIFICATE OF CORRECTION

PATENT NO. : 8,119,063 B2
APPLICATION NO. : 11/722870
DATED : February 21, 2012
INVENTOR(S) : Hachemi Loucif It is certified that error appears in the above-identified patent and that said Letters Patent is hereby corrected as shown below:

Col. 11, Claim 5, line 2, “at least 4.5-5.5 Mn” should read --contains 4.5-5.5 Mn--.

Col. 11, Claim 7, line 2, “contains 0.6 N” should read --contains at least 0.6 N--.

Col. 11, Claim 9, line 2, “contains 0.5 Cu” should read --contains at least 0.5 Cu--.

Signed and Sealed this
Seventeenth Day of April, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,119,063 B2
APPLICATION NO. : 11/722870
DATED : February 21, 2012
INVENTOR(S) : Hachemi Loucif It is certified that error appears in the above-identified patent and that said Letters Patent is hereby corrected as shown below:

Col. 11, line 41 (Claim 5, line 2) "at least 4.5-5.5 Mn" should read --contains 4.5-5.5 Mn--.

Col. 11, line 45 (Claim 7, line 2) "contains 0.6 N" should read --contains at least 0.6 N--.

Col. 11, line 49 (Claim 9, line 2) "contains 0.5 Cu" should read --contains at least 0.5 Cu--.

This certificate supersedes the Certificate of Correction issued April 17, 2012.

Signed and Sealed this
Eighth Day of May, 2012

David J. Kappos

David J. Kappos
*Director of the United States Patent and Trademark Office*